US010288243B2

(12) United States Patent
Matsumoto

(10) Patent No.: US 10,288,243 B2
(45) Date of Patent: May 14, 2019

(54) VEHICLE HEADLAMP AND LIGHT SOURCE UNIT

(71) Applicant: KOITO MANUFACTURING CO., LTD., Tokyo (JP)

(72) Inventor: Hiroki Matsumoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 33 days.

(21) Appl. No.: 15/632,844

(22) Filed: Jun. 26, 2017

(65) Prior Publication Data

US 2017/0370543 A1 Dec. 28, 2017

(30) Foreign Application Priority Data

Jun. 27, 2016 (JP) ..... 2016-126335

(51) Int. Cl.

| | |
|---|---|
| ***F21S 41/19*** | (2018.01) |
| ***F21S 41/25*** | (2018.01) |
| ***F21S 41/30*** | (2018.01) |
| ***F21S 41/32*** | (2018.01) |
| ***F21S 41/39*** | (2018.01) |
| ***F21S 45/47*** | (2018.01) |
| ***F21S 41/147*** | (2018.01) |

(52) U.S. Cl.

CPC ..... *F21S 41/19* (2018.01); *F21S 41/147* (2018.01); *F21S 41/30* (2018.01); *F21S 41/39* (2018.01); *F21S 45/47* (2018.01); *F21S 41/25* (2018.01); *F21S 41/321* (2018.01)

(58) Field of Classification Search

CPC ..... F21S 45/40–45/49; F21S 41/19–41/198

See application file for complete search history.

(56) References Cited

U.S. PATENT DOCUMENTS

| | | | | |
|---|---|---|---|---|
| 9,182,104 | B2 * | 11/2015 | Letoumelin | F21S 41/43 |
| 9,829,172 | B2 * | 11/2017 | Cabanne | F21S 45/49 |
| 9,989,210 | B1 * | 6/2018 | Huang | F21S 45/49 |
| 2006/0215415 | A1 * | 9/2006 | Suzuki | F21S 41/155 362/539 |

(Continued)

FOREIGN PATENT DOCUMENTS

| | | | | |
|---|---|---|---|---|
| JP | 2009076338 A | * | 4/2009 | F21S 45/48 |
| JP | 2009212019 A | * | 9/2009 | |

(Continued)

*Primary Examiner* — Mariceli Santiago

(74) *Attorney, Agent, or Firm* — Sughrue Mion, PLLC

(57) ABSTRACT

A vehicle headlamp includes a lamp chamber and a light source unit. The lamp chamber is defined by assembling a front cover at a front opening portion of a container-shaped lamp body. The light source unit is configured such that a light emitting element that is a light source and a reflector that reflects light emitted from the light emitting element toward a front of the lamp chamber are integrally mounted on an upper surface of a metallic base plate constituting a heat sink in cooperation with a plurality of heat-dissipation fins extending from a lower surface of the base plate, the light source unit arranged in the lamp chamber. The heat-dissipation fins are arranged in parallel in a left and right direction of the base plate and are formed in a substantially L shape in a side view extending in a front and rear direction from a front side of the base plate to a rear upper side of the base plate.

9 Claims, 5 Drawing Sheets

(56) References Cited

U.S. PATENT DOCUMENTS

| | | | | |
|---|---|---|---|---|
| 2010/0046244 | A1* | 2/2010 | Tatsukawa | F21S 41/147 362/539 |
| 2010/0165654 | A1 | 7/2010 | Okubo et al. | |
| 2010/0246204 | A1* | 9/2010 | Inaba | F21S 41/47 362/539 |
| 2015/0204503 | A1* | 7/2015 | Krenn | F21S 45/49 362/514 |
| 2015/0362146 | A1 | 12/2015 | Mochizuki | |
| 2016/0131324 | A1* | 5/2016 | Windgruber | F21S 45/47 362/509 |
| 2016/0265734 | A1* | 9/2016 | Kanayama | F21S 45/47 |
| 2018/0283644 | A1* | 10/2018 | Mertens | F21S 41/147 |

FOREIGN PATENT DOCUMENTS

| | | | | | |
|---|---|---|---|---|---|
| JP | 2009217937 | A | * | 9/2009 | |
| JP | 2010-153333 | A | | 7/2010 | |
| JP | 2011222232 | A | * | 11/2011 | F21S 45/48 |
| JP | 2013062068 | A | * | 4/2013 | F21S 45/47 |
| JP | 2014-146463 | A | | 8/2014 | |
| JP | 2015167072 | A | * | 9/2015 | |
| JP | 2017062886 | A | * | 3/2017 | B60Q 1/0023 |

* cited by examiner

VEHICLE HEADLAMP AND LIGHT SOURCE UNIT

CROSS-REFERENCE TO RELATED APPLICATION

This application claims priority from Japanese Patent Application No. 2016-126335 filed on Jun. 27, 2016, the entire contents of which are incorporated herein by reference.

FIELD

The present invention relates to a vehicle headlamp in which a light source unit where a light emitting element that is a light source and a reflector that reflects light emitted from the light emitting element toward the front are mounted integrally on a heat sink is accommodated in a lamp chamber defined by a lamp body and a front cover. Here, the light emitting element means an element-like light source having a light-emitting part that emits light in a substantially point-like manner. The type of the light emitting element is not particularly limited. For example, a light emitting diode or a laser diode or the like can be adopted.

BACKGROUND

Recently, a vehicle headlamp has been variously proposed as a structure in which a light source unit provided for light distribution formation and having a light emitting element as a light source is accommodated in a lamp chamber in order to reduce power consumption. Thus, a light emitting element capable of obtaining high luminous flux corresponding to the luminosity necessary for light distribution of a headlamp has been developed. However, in this case, the amount of heat generated by the light emitting element has become a problem. That is, in the light emitting element corresponding to the high luminous flux, the high luminous flux is obtained, whereas the amount of generated heat is correspondingly increased. As a result, there occur problems such as a decrease in luminous efficiency or a change in luminescent color.

For these reasons, various structures for increasing the cooling effect of the light emitting element have been proposed. For example, as disclosed in Japanese Patent Laid-Open Publication No. 2010-153333 (see FIGS. 2 and 4), a heat sink 9 is configured such that heat-dissipation fins 11 are formed behind a base plate 10 on which a light emitting element 3 and a reflector 2 are mounted, and thus, the heat generated by the light emitting element 3 is dissipated to the rear side of the heat sink 9.

Further, as disclosed in Japanese Patent Laid-Open Publication No. 2014-146463 (see FIG. 1), a cooling fan 12 is provided so as to directly face heat-dissipation fins 15 of a heat sink 11 on which a light emitting element 14 and a reflector 10 are mounted, thereby promoting the heat-dissipation.

However, in the above Patent Document 1, it is necessary to enlarge the heat-dissipation fins 11 of the heat sink 9 in order to increase the cooling effect of the light emitting element. Thus, the front-rear length of the light source unit is increased. However, there is a limit in relation to an accommodation space of the light source unit in a lamp chamber.

Further, in the above Patent Document 2, the cooling effect is increased by the flow of air generated by the cooling fan 12 without enlarging the heat-dissipation fins 15. However, the number of parts constituting the light source unit is increased. Accordingly, the configuration becomes complicated, the weight is increased, and the cost is also increased.

SUMMARY

The present invention has been made in view of the above-described problems of the prior art and an object thereof is to provide a vehicle headlamp including a light source unit which is not provided with a cooling fan but is compact and excellent in the cooling effect of a light emitting element.

In order to achieve the above object, first aspect of embodiments provides a vehicle headlamp comprising: a lamp chamber defined by assembling a front cover at a front opening portion of a container-shaped lamp body; a light source unit configured such that a light emitting element that is a light source and a reflector that reflects light emitted from the light emitting element toward a front of the lamp chamber are integrally mounted on an upper surface of a metallic base plate constituting a heat sink in cooperation with a plurality of heat-dissipation fins extending from a lower surface of the base plate, the light source unit arranged in the lamp chamber, wherein the heat-dissipation fins are arranged in parallel in a left and right direction of the base plate and are formed in a substantially L shape in a side view extending in a front and rear direction from a front side of the base plate to a rear upper side of the base plate.

(Function)

The heat of the light emitting element is transferred to the heat-dissipation fins via the base plate of the heat sink and is dissipated from the heat-dissipation fins into the air. The heat-dissipation fins are adjacent to each other in the left and right direction of the base plate and extend in a substantially L shape in a side view from the front side to the lower side and the rear upper side of the base plate, and the heat-dissipation area of the heat sink (heat-dissipation fins) is large. That is, as compared with a conventional heat sink (a structure in which the heat-dissipation fins are formed on the lower side or the rear side of the base plate), the heat sink (heat-dissipation fins) of the present invention has a larger heat-dissipation area and is also excellent in the cooling effect of the light emitting element.

Particularly, the distances from the heat-dissipation fins extending on the front side of the base plate and the heat-dissipation fins extending on the rear side of the base plate to the light emitting element on the base plate are substantially the same, and the heat can be almost uniformly dissipated from the lower side, the front side and the rear side of the heat sink. As a result, the cooling effect of the light emitting element is correspondingly excellent and the light emitting element can be effectively cooled without adopting large heat-dissipation fins or an air-cooling fan.

In addition to first aspect of embodiments, second aspect of embodiments has a configuration that the base plate is disposed to be inclined forward or rearward.

(Function)

The heat of the light emitting element that is a light source is dissipated into the air from the heat-dissipation fins formed in a substantially L shape in a side view extending from the front side to the rear upper side of the base plate. When the base plate is horizontally disposed, the heat of the light emitting element is uniformly transferred from the light emitting element mounting position of the base plate in a radial direction in a plan view. That is, the heat transfer amount is constant at any position around the light emitting element. However, when the base plate is inclined, the heat transfer amount in the inclined direction is smaller than that in the opposite direction. In other words, the movement (transfer) of heat is promoted in the direction opposite to the direction in which the base plate is inclined.

For these reason, in second aspect of embodiments, the base plate is made to be inclined in the front and rear direction. Although the total amount of heat transferred from the light emitting element to the heat-dissipation fins via the base plate is the same, the movement (transfer) of heat to the rear side (front side) of the base plate is promoted in a form in which the base plate is inclined forward (rearward). As a result, the heat-dissipation amount from the heat-dissipation fins extending on the rear side (front side) of the base plate is increased, as compared with the heat-dissipation amount from the heat-dissipation fins extending on the front side (rear side) of the base plate.

Furthermore, as the warmed air on the lower surface of the base plate ascends along the lower surface of the base plate inclined, the flow of air is generated in an air passage which is constituted by the heat-dissipation fins extending from the lower surface to the front side and the rear upper side of the base plate and which has a substantially L shape in a side view extending in the front and rear direction. This flow of air increases the heat-dissipation of the heat sink.

For example, in the case where there is a difference in the heat-dissipation area of the heat-dissipation fins formed respectively at the front and rear of the base plate due to the difference in the number and size of the heat-dissipation fins, the base plate is disposed to be inclined (forward or rearward) in the front and rear direction so that more (less) heat is transferred to the heat-dissipation fins with a larger (smaller) heat-dissipation area. In this way, the cooling effect of the light emitting element can be increased.

In addition to second aspect of embodiments, third aspect of embodiments has a configuration that the base plate of the heat sink is disposed to be inclined rearward, front edge portions of the heat-dissipation fins extending on the front side of the base plate are brought into contact with another constituent member of the light source unit disposed adjacent to a front of the heat sink or are integrated with an upright wall extending in the left and right direction, and a chimney is provided in an air passage constituted by the heat-dissipation fins extending on the front side of the base plate.

(Function)

A front air passage formed by the heat-dissipation fins extending on the front side of the base plate communicates with a rear air passage extending in the up and down direction and formed by the heat-dissipation fins extending on the rear side of the base plate via a lower air passage formed by the heat-dissipation fins extending in the front and rear direction on the lower surface of the base plate. That is, an air passage having a substantially L shape in a side view extending in the front and rear direction is formed by the heat-dissipation fins extending from the lower surface of the base plate to the front side and the rear upper side of the base plate. These heat-dissipation fins have a substantially L shape in a side view and are adjacent to each other in the left and right direction.

Then, by arranging the base plate to be inclined rearward, firstly, the movement of heat to the front side of the heat sink (base plate) is promoted. Secondly, when the air in the lower air passage, which is warmed by taking heat from the heat-dissipation fins extending in the front and rear direction on the lower surface of the base plate, ascends along the lower surface of the base plate inclined rearward, the forward flow of air is generated in the lower air passage. In this way, as indicated by the arrow in FIG. 2, circulating air convection is formed around the heat sink. The air convection vertically turns forward-upward and rearward-downward in the route of the lower air passage→the front air passage→above the reflector→the rear air passage→the lower air passage. As a result, the light emitting element can be effectively cooled.

Furthermore, the flow of air flowing upward along the front air passage is accelerated by the chimney effect of the front air passage formed by the heat-dissipation fins extending on the front side of the base plate. In this way, the circulating air convection, which is formed around the heat sink and vertically turns forward-upward and rearward-downward, becomes active. As a result, the light emitting element can be more effectively cooled.

In addition to any one of first to third aspects of embodiments, fourth aspect of embodiments has a configuration that the base plate is formed in an L-shaped longitudinal section, a vertical rod-shaped portion of the L-shaped longitudinal section of the base plate is formed in a substantially circular arc shape in a plan view surrounding the light emitting element, out of the plurality of heat-dissipation fins extending rearward from a back side of the vertical rod-shaped portion of the L-shaped longitudinal section of the base plate, at least the heat-dissipation fins closer to both sides in a width direction of the base plate extend in a radial direction with respect to the light emitting element, and extended ends of the plurality of heat-dissipation fins are arranged along a substantially circular arc shape in a plan view to follow a substantially circular arc shape in a plan view of the vertical rod-shaped portion of the L-shaped longitudinal section of the base plate.

(Function)

A large number of heat-dissipation fins extend rearward from the vertical rod-shaped portion of the L-shaped longitudinal section of the base plate formed in the L-shaped longitudinal section. The distances from the light emitting element to the rear extended ends of the respective heat-dissipation fins are substantially the same. Therefore, the amount of heat transferred from the base plate to the respective heat-dissipation fins extending rearward and the amount of heat dissipated from the respective heat-dissipation fins into the air are uniformly distributed. As a result, the heat-dissipation effect to the rear side of the heat sink is increased.

Particularly, in the region where the heat-dissipation fins extend from the vertical rod-shaped portion of the L-shaped longitudinal section of the base plate in the radial direction with respect to the light emitting element, gaps between the heat-dissipation fins adjacent to each other in a circumferential direction are enlarged toward the extended ends of the heat-dissipation fins, and thus, the flow of air in the rear air passage formed between the adjacent heat-dissipation fins and extending in the up and down direction becomes smooth. As a result, the heat-dissipation effect to the rear side of the heat sink is correspondingly increased.

Further, since the rear extended ends of the heat-dissipation fins extending rearward from the vertical rod-shaped portion of the L-shaped longitudinal section of the base plate are arranged along a substantially circular arc shape in a plan view to follow a substantially circular arc shape in a plan view of the vertical rod-shaped portion of the L-shaped longitudinal section of the base plate, the rear shape of the heat sink, i.e., the rear shape of the light source unit is formed in a substantially circular arc shape in a plan view surrounding the light emitting element. Therefore, a swinging radius of the light source unit is reduced when an aiming operation or a swivel driving of the light source unit is performed. Correspondingly, the light source unit hardly interferes with the lamp body or another lamp constituent member disposed near the light source unit in the lamp chamber.

Fifth aspect of embodiments provides a light source unit in which a light emitting element that is a light source is mounted on an upper surface of a metallic base plate constituting a heat sink in cooperation with a plurality of heat-dissipation fins extending from a lower surface of the base plate, wherein the heat-dissipation fins are arranged in parallel in a predetermined direction of the base plate and are formed in a substantially L shape in a side view extending beyond the base plate in a direction orthogonal to an arrangement direction.

(Function)

The heat of the light emitting element is transferred to the heat-dissipation fins via the base plate of the heat sink and is dissipated from the heat-dissipation fins into the air. The heat-dissipation fins are adjacent to each other in the arrangement direction and are formed in a substantially L shape in a side view extending beyond the base plate in the direction orthogonal to the arrangement direction. Therefore, the heat-dissipation area of the heat sink (heat-dissipation fins) is large. That is, as compared with a conventional heat sink (a structure in which the heat-dissipation fins are formed on the lower side or the rear side of the base plate), the heat sink (heat-dissipation fins) of the present invention has a larger heat-dissipation area and is also excellent in the cooling effect of the light emitting element.

In particular, the distances from the portion of the heat-dissipation fins extending beyond the base plate to the light emitting element on the base plate are substantially the same and the heat can be almost uniformly dissipated from the entire of the heat-dissipation fins having a substantially L shape in a side view. Thus, the cooling effect of the light emitting element is correspondingly excellent and the light emitting element can be effectively cooled without adopting large heat-dissipation fins or an air-cooling fan.

As is apparent from the above description, according to first aspect of embodiments, the vehicle headlamp including the light source unit which is not provided with a cooling fan but is compact and excellent in the cooling effect of the light emitting element can be provided at low cost.

According to second aspect of embodiments, the heat sink is disposed to be inclined forward or rearward in accordance with the specification (characteristic) of the heat sink, i.e., whether the heat is positively dissipated from either the front side or the rear side of the heat sink. In this way, the light emitting element can be effectively cooled.

According to third aspect of embodiments, the active circulating air convection, which vertically turns forward-upward and rearward-downward, is formed around the heat sink of the light source unit. In this way, the light emitting element can be more effectively cooled.

According to fourth aspect of embodiments, it is possible to provide the vehicle headlamp which is excellent in the heat-dissipation to the rear side of the heat sink and is correspondingly excellent in the cooling effect of the light emitting element and in which the aiming operation or swivel operation of the light source unit can be smoothly performed.

According to fifth aspect of embodiments, it is possible to provide the light source unit which is not provided with a cooling fan but is compact and excellent in the cooling effect of the light emitting element.

DETAILED DESCRIPTION

Figure 1:
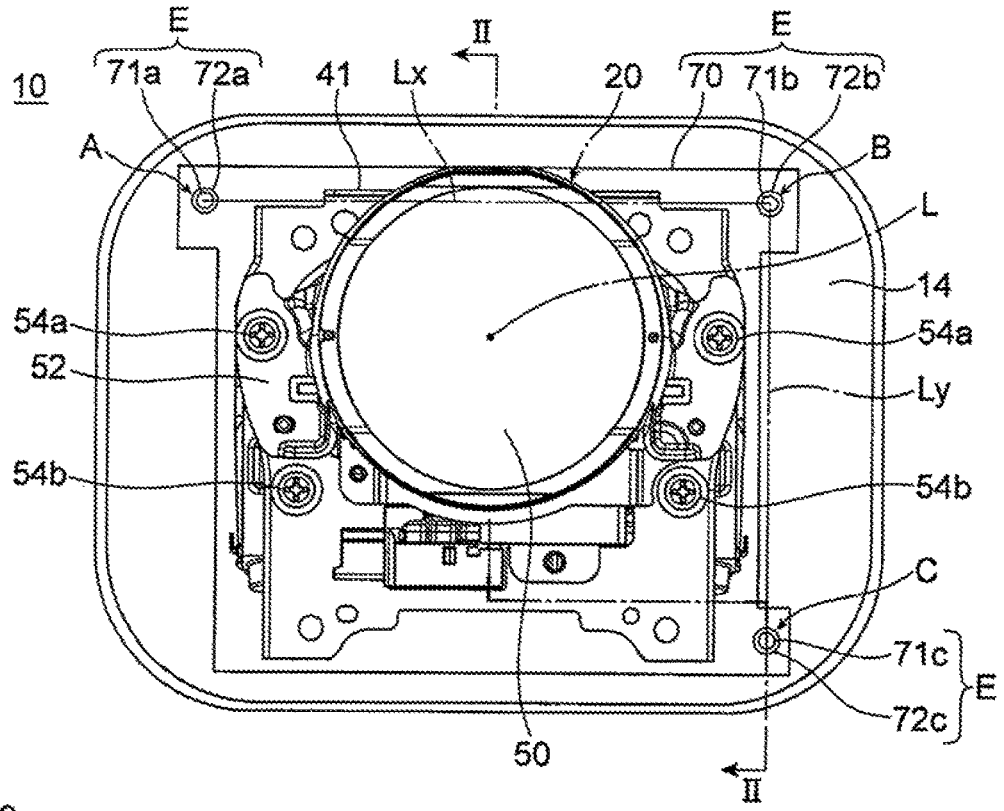
FIG. 1 is a front view of an automobile headlamp according to a first embodiment of the present invention.

Next, embodiments of the present invention will be described on the basis of examples.

In FIGS. 1 to 6 showing an automobile headlamp 10 according to an example of the present invention, the automobile headlamp 10 is configured in such a way that a projection type light source unit 20 having a light emitting element (LED for high luminous flux) 22 as a light source is accommodated in a lamp chamber defined by a container-shaped lamp body 12 opened on the front side and a plain translucent cover (front cover) 14 attached to the front opening portion.

The light source unit 20 includes an aluminum die-cast heat sink 30 in which a large number of heat-dissipation fins 34 extend from a base plate 31 having an L-shaped longitudinal section. The light emitting element (LED for high luminous flux) 22 that is a light source and a resin reflector 24 that reflects light emitted from the light emitting element 22 toward the front side are attached on an upper surface of a horizontal rod-shaped portion (hereinafter, referred to as a "horizontal base plate") 31*a* of the L-shaped longitudinal section of the base plate 31.

Figure 3:
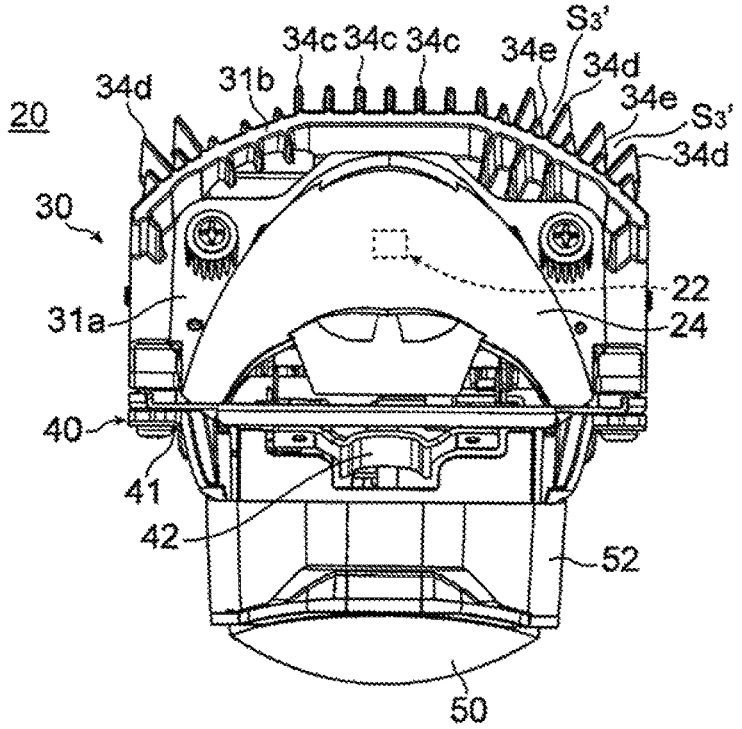
FIG. 3 is a plan view of a light source unit that is a main part of the headlamp.
Figure 4:
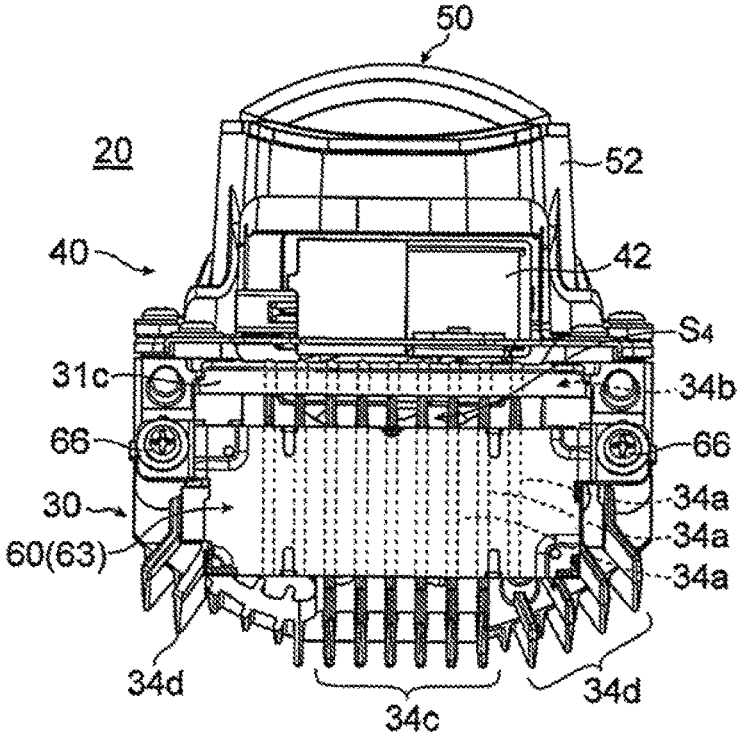
FIG. 4 is a bottom view of the light source unit.
Figure 5:
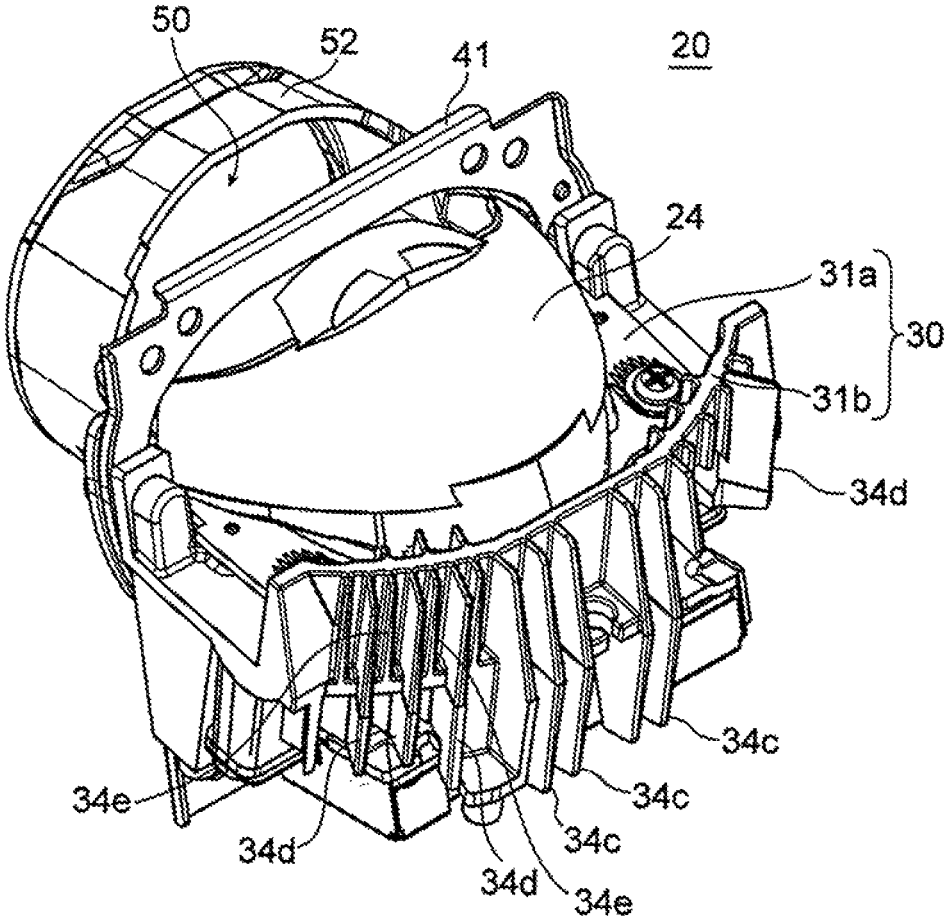
FIG. 5 is a back perspective view of the light source unit.

Specifically, a pedestal 32 for attaching the light emitting element is provided at the central portion of the upper surface of the horizontal base plate 31*a* constituting the heat sink 30. The pedestal 32 has an element mounting surface 32*a* parallel to upper and lower surfaces of the base plate 31. The light emitting element 22 is attached to the pedestal 32 with its irradiation axis facing upward. The reflector 24 is attached to the rear side of the upper surface of the horizontal base plate 31*a* and is disposed so as to cover the upper side of the light emitting element 22. As shown in FIGS. 3, 4 and 5, a vertical rod-shaped portion (hereinafter, referred to as a "vertical base plate") 31*b* of the L-shaped longitudinal section of the base plate 31 constituting the heat sink 30 is formed in a substantially circular arc shape in a plan view with the pedestal 32 as the center. On the back side of the vertical base plate 31*b*, heat-dissipation fins 34*c*, 34*d* formed to extend rearward at equal intervals in the left and right direction are extended in the up and down direction.

Then, a projection lens 50 made of resin is disposed in front of the heat sink 30. A shade mechanism 40 for switching light distribution is arranged between the reflector 24 and the projection lens 50. The shade mechanism 40 includes a movable shade 43. These parts are integrated as the light source unit 20.

Figure 6:
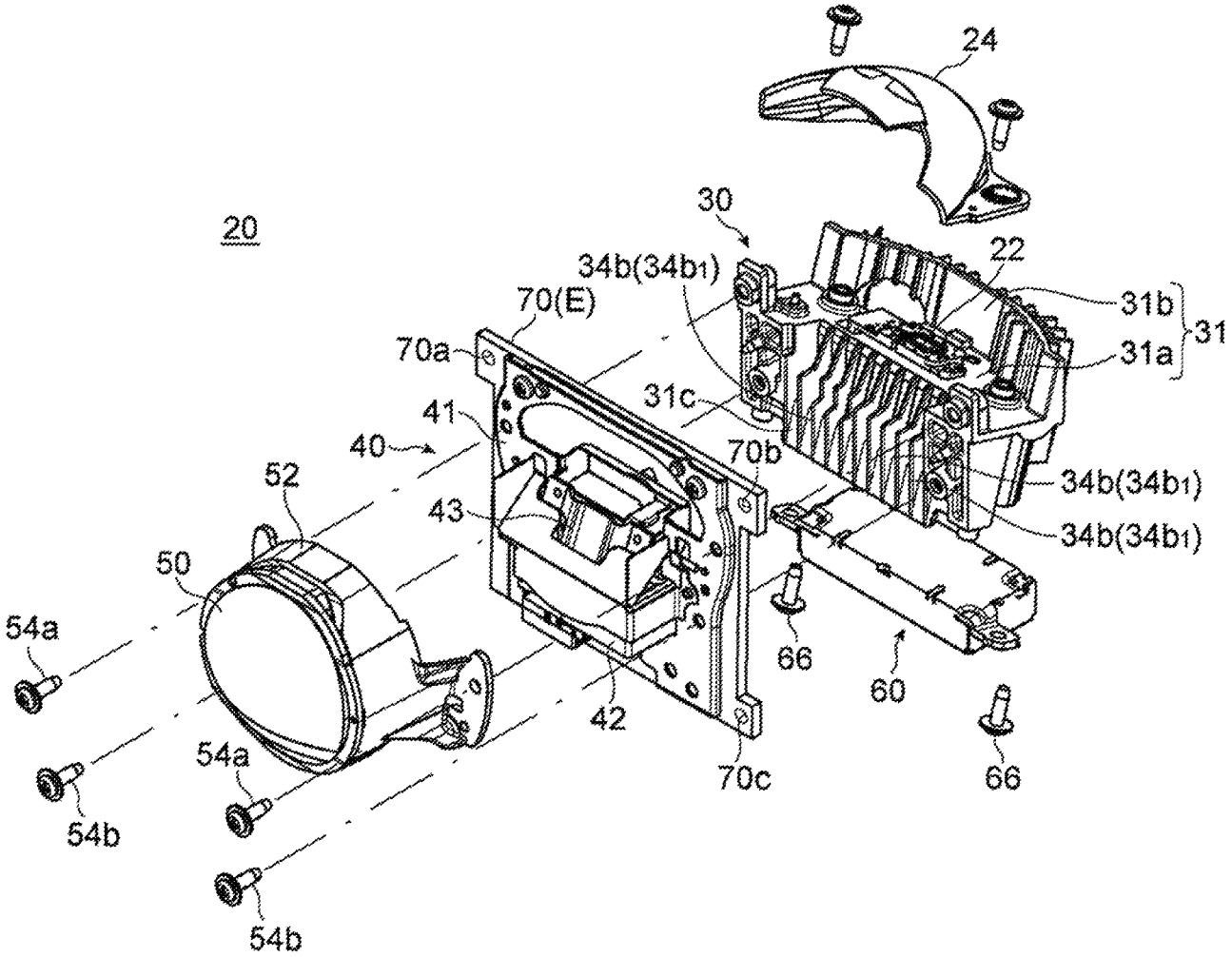
FIG. 6 is an exploded perspective view of the light source unit.

Specifically, as shown in FIG. 6, on the front side of the heat sink 30, a lens holder 52 for holding the projection lens 50 and a support plate 41 constituting the shade mechanism 40 for switching light distribution are fastened and fixed together by two fastening screws 54*a*. The support plate 41 has a rectangular shape in a front view and is opened on the central portion. The projection lens 50 is disposed on an optical axis L (see FIGS. 1 and 2) of the light source unit 20. Meanwhile, a reference numeral 54*b* refers to a fastening screw for fixing the support plate 41 of the shade mechanism 40 for switching light distribution to the heat sink 30.

Figure 2:
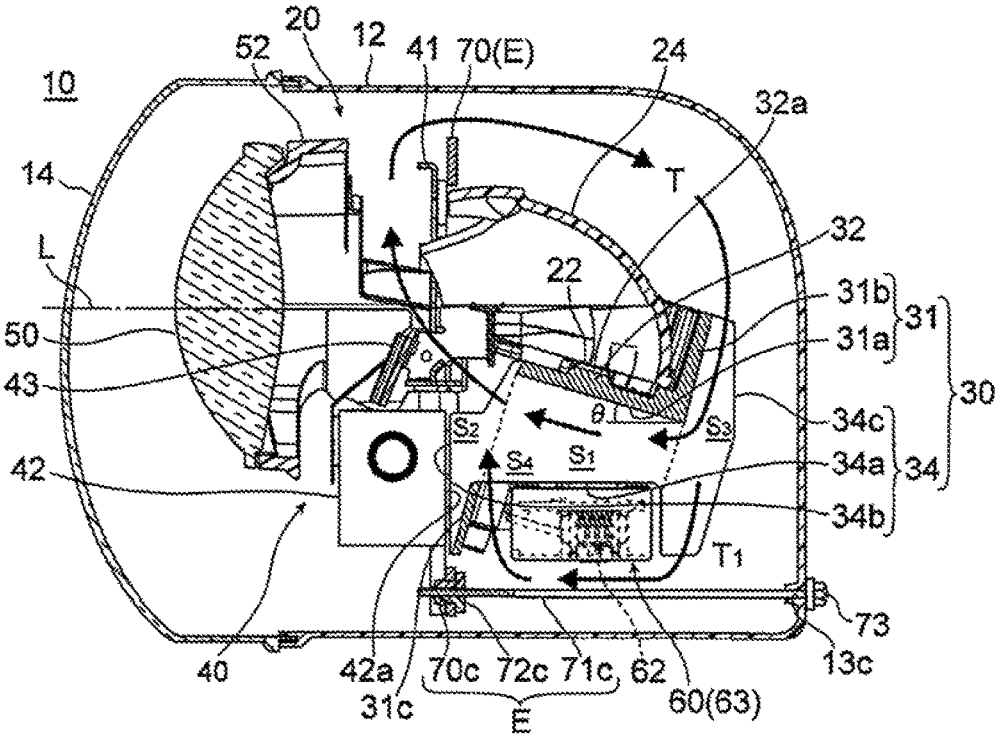
FIG. 2 is a longitudinal sectional view of the headlamp, taken along the line II-II shown in FIG. 1.

Further, as shown in FIGS. 2, 4 and 6, on the lower surface side of the heat sink 30, a lighting circuit unit 60 for controlling the lighting of the light emitting element 22 is fixed by two screws 66. A lighting circuit 62 is composed of a circuit board on which electronic components (circuit elements) are mounted. The lighting circuit 62 is accommodated in a lighting circuit housing 63 and integrated as the lighting circuit unit 60 (see FIG. 2).

Then, as the movable shade 43 is swung in the front and rear direction by the driving of an electromagnetic solenoid 42 constituting the shade mechanism 40 for switching light distribution, the light distribution formed by the light source unit 20 is switched between a low beam and a travelling beam.

Further, as shown in FIGS. 1 and 2, the light source unit 20 accommodated in the lamp chamber is supported at three points including a pair of aiming points A, B and one aiming point C. The pair of aiming points A, B is spaced apart in the left and right direction on the upper side of the inside of the lamp chamber, and the aiming point C is located almost just below the aiming point B. The light source unit 20 is supported by an aiming mechanism E so as to be tiltable around a horizontal tilt axis Lx passing through the aiming points A, B and a vertical tilt axis Ly passing through the aiming points B, C, respectively.

Specifically, as shown in FIGS. 1 and 2, an aiming bracket 70 is integrally fixed on the back side of the support plate 42 of the shade mechanism 40 for switching light distribution integrated as the light source unit 20. The aiming bracket 70 is provided with holes 70*a*, 70*b*, 70*c* (holes 70*a*, 70*b* are not shown) corresponding to the aiming points A, B, C and has a rectangular frame shape that is one size larger than the support plate 41. On the other hand, through-holes 13*a*, 13*b*, 13*c* (through-holes 13*a*, 13*b* are not shown) corresponding to the aiming points A, B, C are provided in the back surface wall of the lamp body 10. Aiming screws 71*a*, 71*b*, 71*c* each provided with a pivot operation part 73 are rotatably supported in the through-holes 13*a*, 13*b*, 13*c* and extend into the lamp chamber. Bearing nuts 72*a*, 72*b*, 72*c* are mounted in the holes 70*a*, 70*b*, 70*c* of the bracket 70. The bearing nuts 72*a*, 72*b*, 72*c* are screwed to leading ends of the aiming screws 71*a*, 71*b*, 71*c*, respectively.

That is, the aiming mechanism E is constituted by the aiming bracket 70 for supporting the light source unit 20, the three aiming screws 71*a*, 71*b*, 71*c* and the three bearing nuts 72*a*, 72*b*, 72*c*. The tilting of the optical axis L of the light source unit 20 can be adjusted in the left and right direction (the up and down direction) by a pivoting operation of the aiming screw 71*a* (71*c*). Meanwhile, the aiming bracket 70 is not shown in FIGS. 3, 4 and 5.

Further, in the present embodiment, the light emitting element 22 (LED for high luminous flux) 22 corresponding to the luminosity necessary for light distribution of the headlamp is adopted as a light source of the light source unit 20, and thus, the heat generation amount of the light emitting element 22 is large. Therefore, it is necessary to effectively cool the light emitting element 22 and the lighting circuit unit 60 so that the light emitting element 22 and (electronic components of) the lighting circuit 52 are not affected by the heat generated from the light emitting element 22.

Therefore, in the present embodiment, as shown in FIG. 2, the heat-dissipation fins 34 extend in a plate-like manner in the front and rear direction and extend to be equally spaced in the left and right direction (width direction) on the lower surface of the horizontal base plate 31*a* of the heat sink 30. The heat-dissipation fins 34 are formed in a substantially L shape in a side view from the front lower side to the rear upper side of the horizontal base plate 31*a*. In this way, a large heat-dissipation area is secured. Further, the lighting circuit unit 60 is disposed at a position immediately below the heat-dissipation fins 34 on the lower side of the horizontal base plate 31*a* of the heat sink 30. At this position, the lighting circuit unit 60 is unlikely to be affected by the heat of the light emitting element 22 as much as possible.

Specifically, as shown in FIGS. 2 and 4, on the lower surface of the horizontal base plate 31*a*, nine lower heat-dissipation fins 34*a* are formed at equal intervals in the left and right direction so as to extend in the front and rear direction. Then, the lower heat-dissipation fins 34*a* are respectively continuous with nine front heat-dissipation fins 34*b* (see FIGS. 2 and 6) extending substantially in a vertical direction to the front lower side of the horizontal base plate 31*a*. Further, the lower heat-dissipation fins 34*a* are continuous with rear heat-dissipation fins 34*c*, 34*d* (see FIGS. 2, 3, 4 and 5) extending rearward from the vertical base plate 31*b* and extending in the up and down direction. That is, the heat-dissipation fins 34 are formed in a plate shape in which the front heat-dissipation fins 34*b*, the lower heat-dissipation fins 34*a* and the rear heat-dissipation fins 34*c* (34*d*) are integrally continuous. Meanwhile, the nine front heat-dissipation fins 34*b* formed at equal intervals in the left and right direction are integrally formed with an inclined upright wall 31*c* (see FIGS. 2, 4 and 6) crossing the rear lower side of the front heat-dissipation fins 34*b* in the left and right direction, so that the rigidity of the heat-dissipation fins 34 (front heat-dissipation fins 34*b*) is secured.

Then, the heat of the light emitting element 22 is transferred to the heat-dissipation fins 34 (34*a*, 34*b*, 34*c*, 34*d*) via the base plate 31 and is dissipated from the heat-dissipation fins 34 into the air. The heat-dissipation fins 34 are adjacent to each other in the left and right direction of the base plate 31 and extend in a substantially L shape in a side view from the front side to the lower side and the rear upper side of the base plate 31. As compared with a conventional heat sink, the heat sink 30 has a larger heat-dissipation area and is excellent in the cooling effect of the light emitting element 22.

In particular, the distances from the front heat-dissipation fins 34*b* extending on the front lower side of the base plate 31 and the rear heat-dissipation fins 34*c*, 34*d* extending in the up and down direction on the rear side of the base plate 31 to the light emitting element 22 on the base plate 31 are substantially the same, and the heat can be almost uniformly dissipated from the lower side, the front side and the rear side of the heat sink 30. As a result, the cooling effect of the light emitting element 22 is correspondingly excellent and the light emitting element 22 can be effectively cooled without adopting large heat-dissipation fins or an air-cooling fan.

Further, as shown in FIG. 2, the heat sink 30 is disposed such that the horizontal base plate 31*a* is inclined rearward by a predetermined angle θ with respect to the horizontal. Thus, the movement (transfer) of heat to the front side of the heat sink 30 (horizontal base plate 31*a*) is promoted. Further, front edge portions 34*b*1 of the front heat-dissipation fins

34*b* extending on the front lower side of the horizontal base plate 31*a* are brought into contact with a housing back side 42*a* of the solenoid 42 of the shade mechanism 40 for switching light distribution disposed adjacent to the front of the heat sink 30, so that a chimney is formed in a front air passage S2 formed by the front heat-dissipation fins 34*b* and extending in the up and down direction. In this way, circulating air convection T formed around the heat sink 30 becomes active. As a result, the light emitting element 22 and the lighting circuit unit 60 is more effectively cooled.

Hereinafter, the circulating air convection T formed around the heat sink 30 is described.

On the lower side of the horizontal base plate 31*a*, a lower air passage S1 extending in the front and rear direction is formed by the lower heat-dissipation fins 34*a* adjacent to each other in the left and right direction (width direction). On the front lower side of the horizontal base plate 31*a*, the front air passage S2 extending in the up and down direction is formed by the front heat-dissipation fins 34*b* adjacent to each other in the left and right direction (width direction). On the rear side of the horizontal base plate 31*a* (the rear side of the vertical base plate 31*b*), a rear air passage S3 extending in the up and down direction is formed by the rear heat-dissipation fins 34*c* adjacent to each other in the left and right direction (width direction). Then, the front air passage S2 communicates with the rear air passage S3 via the lower air passage S1 below the horizontal base plate 31*a*. That is, the air passages S (S1, S2, S3) extending in the front and rear direction and having a substantially L shape in a side view are formed between the heat-dissipation fins 34 (34*a*, 34*b*, 34*c*, or 34*d*) extending from the lower side of the horizontal base plate 31*a* to the front side of the horizontal base plate 31*a* and the rear side of the vertical base plate 31*b*. The heat-dissipation fins 34 (34*a*, 34*b*, 34*c*, or 34*d*) are adjacent to each other in the left and right direction (width direction) and have a substantially L shape in a side view.

Then, by arranging the horizontal base plate 31*a* of the heat sink 30 to be inclined rearward, firstly, the movement (transfer) of heat to the front side of the heat sink 30 (horizontal base plate 31*a*) is promoted. Secondly, when the air in the lower air passage S1, which is warmed by taking heat from the front heat-dissipation fins 34*b*, ascends along the lower surface of the horizontal base plate 31*a* inclined rearward, the forward flow of air is generated in the lower air passage S1. In this way, as indicated by the arrow in FIG. 2, the circulating air convection T is formed around the heat sink 30. The air convection T vertically turns forward-upward and rearward-downward in the route of the lower air passage S1→the front air passage S2→above the reflector 24→the rear air passage S3→the lower air passage S1. As a result, the light emitting element 22 and the lighting circuit unit 60 are effectively cooled.

Furthermore, the flow of air flowing upward in the front air passage S2 is accelerated by the chimney effect of the front air passage S2 formed by the front heat-dissipation fins 34*b* of the heat sink 30. In this way, the circulating air convection T formed around the heat sink 30 becomes active. As a result, the light emitting element 22 and the lighting circuit unit 60 are more effectively cooled.

Particularly, the lighting circuit unit 60 is disposed below the horizontal base plate 31*a* of the heat sink 30. As shown in FIGS. 2 and 4, the lighting circuit unit 60 is disposed near the rear side of the lower heat-dissipation fins 34*a*, and the lower portion between the lower air passage S1 and the front air passage S2 is opened. Therefore, new air under the heat sink 30 is taken into the front air passage S2 through a lower opening portion S4 of the front air passage S2, so that the chimney effect of the front air passage S2 is further enhanced. That is, the flow of air flowing upward in the front air passage S2 is further accelerated, and thus, circulating air convection T1 (see FIG. 2) is formed. The circulating air convection T1 vertically turns in the route of the lower opening portion S4→the front air passage S2→above the reflector 24→the rear air passage S3→below the lighting circuit unit 60→the lower opening portion S4.

Therefore, the circulating air convection formed around the heat sink 30 and vertically turning forward-upward and rearward-downward becomes more active. As a result, the light emitting element 22 and the lighting circuit unit 60 is more effectively cooled.

Further, as shown in FIGS. 3 and 6, the vertical base plate 31*b* of the heat sink 30 is formed in a substantially circular arc shape in a plan view surrounding the light emitting element 22. The rear heat-dissipation fins 34*c*, 34*d* extending on the back side of the vertical base plate 31*b* extend downward and are continuous with the lower heat-dissipation fins 34*a*. Further, as shown in FIGS. 4 and 5, the heat-dissipation fins 34*c* formed near the central portion in the width direction on the back side of the vertical base plate 31*b* extend rearward at equal intervals in the left and right direction, and the heat-dissipation fins 34*d* formed near both sides in the width direction on the back side of the vertical base plate 31*b* extend in the radial direction with respect to the light emitting element 22. Thus, the extended ends of the heat-dissipation fins 34*c*, 34*d* are arranged along a substantially circular arc shape in a plan view to follow a substantially circular arc shape in a plan view of the vertical base plate 31*b*.

Therefore, since the distances from the light emitting element 22 to the extended ends of the respective heat-dissipation fins 34*c*, 34*d* are substantially the same, the amount of heat transferred to the respective heat-dissipation fins 34*c*, 34*d* and the amount of heat dissipated from the respective heat-dissipation fins 34*c*, 34*d* into the air are uniformly distributed, and thus, the heat-dissipation effect to the rear side of the heat sink 20 is enhanced.

In particular, gaps between the heat-dissipation fins 34*d*, 34*d* adjacent to each other in the circumferential direction are enlarged toward the extended ends of the heat-dissipation fins 34*d*, and thus, the flow of air in a rear air passage S3' (see FIG. 3) formed between the adjacent heat-dissipation fins 34*d*, 34*d* and extending in the up and down direction is smoothly increased. As a result, the heat-dissipation effect to the rear side of the heat sink 30 is correspondingly increased.

Furthermore, heat-dissipation fins 34*e* extending rearward from the vertical base plate 31*b* and having a short extending length are provided between the heat-dissipation fins 34*d*, 34*d* adjacent to each other in the circumferential direction, and thus, the heat-dissipation area on the back side of the vertical base plate 31*b* is increased. In this way, the heat-dissipation effect to the rear side of the heat sink 30 is correspondingly increased.

Further, since the rear extended ends of the heat-dissipation fins 34*d* are arranged along a substantially circular arc shape in a plan view to follow a substantially circular arc shape in a plan view of the vertical base plate 31*b*, the rear shape of the heat sink 30, i.e., the rear shape of the light source unit 20 is formed in a substantially circular arc shape in a plan view surrounding the light emitting element 22. Therefore, a swinging radius of the light source unit 20 is reduced when an aiming operation of the light source unit 20 is performed. Correspondingly, the light source unit hardly interferes with the lamp body 12 or another lamp constituent member disposed near the light source unit 20 in the lamp chamber.

Figure 7:
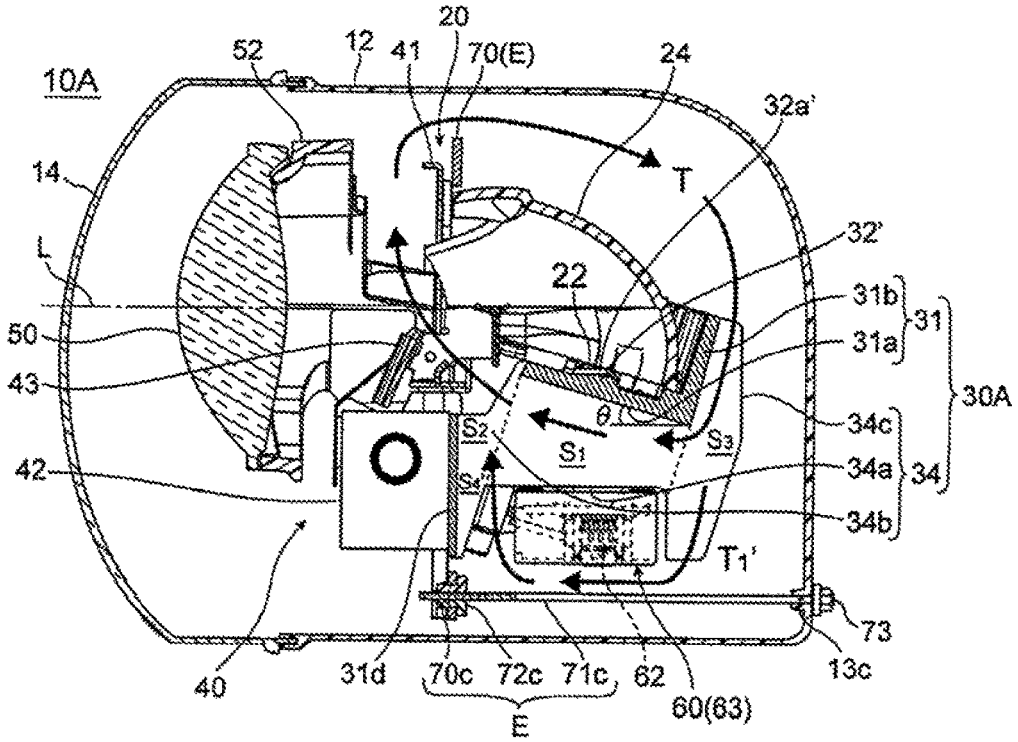
FIG. 7 is a longitudinal sectional view of an automobile headlamp according to a second embodiment of the present invention.
Figure 8:
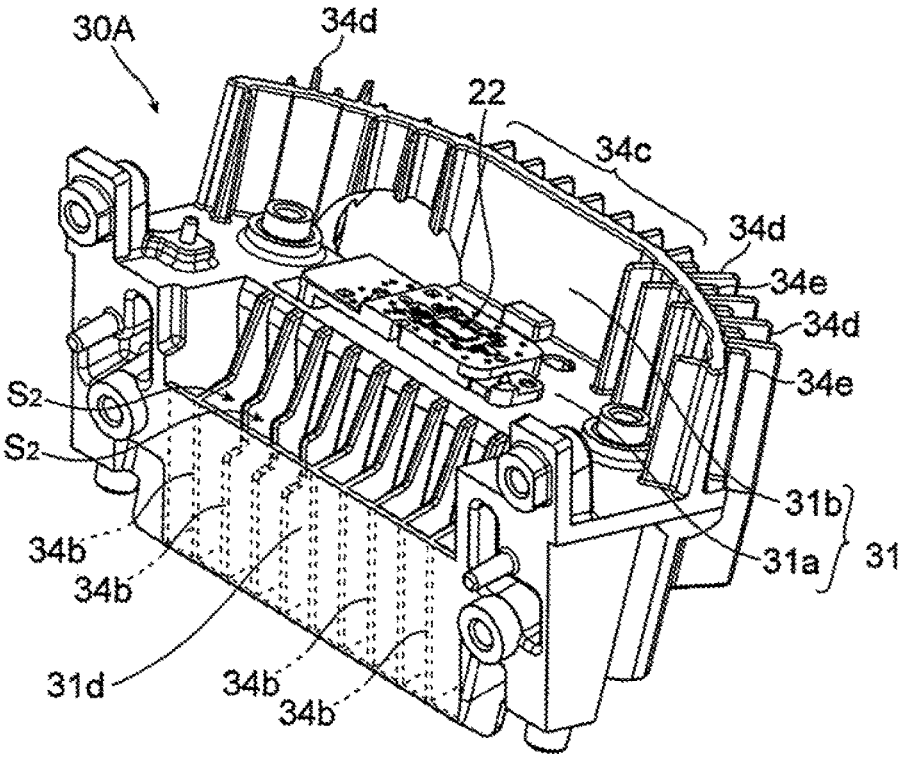
FIG. 8 is a perspective view of a heat sink integrated with a light source unit that is a main part of the headlamp.

FIGS. 7 and 8 show an automobile headlamp according to a second embodiment of the present invention. FIG. 7 is a longitudinal sectional view of the automobile headlamp, and FIG. 8 is a perspective view of a heat sink integrated with the light source unit that is a main part of the headlamp.

In the headlamp 10 according to the first embodiment described above, the pedestal 32 for attaching the light emitting element is provided on the central portion of the upper surface of the horizontal base plate 31*a* of the heat sink 30, and the element mounting surface 32*a* of the pedestal 32 is configured by a surface parallel to the upper and lower surfaces of the horizontal base plate 31*a*. Therefore, the horizontal base plate 31*a* is disposed in the lamp chamber to be inclined rearward by the predetermined angle θ with respect to the horizontal, so that the irradiation axis of the light emitting element 22 attached to the pedestal 32 is inclined rearward by the predetermined angle θ (predetermined angle corresponding to the rearward inclination angle of the horizontal base plate 31*a*).

On the other hand, in a headlamp 10A according to the present embodiment, in the case where the horizontal base plate 31*a* of a heat sink 30A is disposed in the lamp chamber to be inclined rearward by the predetermined angle θ with respect to the horizontal, an element mounting surface 32*a*' of a pedestal 32' for attaching the light emitting element is horizontal, and thus, the irradiation axis of the light emitting element 22 attached to the pedestal 32' is vertical.

Further, in the headlamp 10 according to the first embodiment described above, the front edge portions 34*b*1 of the front heat-dissipation fins 34*b* of the heat sink 30 are brought into contact with the housing back side 42*a* of the electromagnetic solenoid 42 of the movable shade mechanism 40 for switching light distribution disposed adjacent to the front of the heat sink 30, so that a chimney is formed in the front air passage S2 of the heat sink 30. On the contrary, in the headlamp 10A according to the present embodiment, an upright wall 31*d* crossing the front lower side of the horizontal base plate 31*a* in the left and right direction is formed integrally with the front edge portions of the front heat-dissipation fins 34*b* of the heat sink 30A, so that a chimney is formed in the front air passage S2 formed by the front heat-dissipation fins 34*b*.

Further, since the rigidity of the heat-dissipation fins 34 (front heat-dissipation fins 34*b*) can be secured by the upright wall 31*d* provided at the front edge side of the front heat-dissipation fins 34*d*, the inclined upright wall 31*c* (see FIGS. 2, 4 and 6) provided in the first embodiment is removed.

Therefore, as shown in FIG. 7, a lower opening portion S4' of the front air passage S2 is largely opened, as compared to the case of the first embodiment described above. New air under the heat sink 30 is more taken into the front air passage S2 through the lower opening portion S4'. Thus, the chimney effect of the front air passage S2 is further enhanced, as compared to the case of the first embodiment. That is, the flow of air flowing upward in the front air passage S2 is further accelerated, so that circulating air convection T1' (see FIG. 7) becomes more active. The circulating air convection T1' vertically turns in the route of the lower opening portion S4'→the front air passage S2→above the reflector 24→the rear air passage S3→below the lighting circuit unit 60→the lower opening portion S4'. In this way, the light emitting element 22 and the lighting circuit unit 60 are more effectively cooled, as compared to the case of the first embodiment.

Since the other parts are the same as those of the first embodiment and are denoted by the same reference numerals, duplicate explanation thereof will be omitted.

Further, in the first and second embodiments described above, the aiming mechanism E allows the light source unit 20 to be tiltable around the horizontal tilt axis Lx and the vertical tilt axis Ly, respectively. For example, the light source unit 20 may be swung in the horizontal direction around a swivel axis by a swivel mechanism and the optical axis L of the light source unit 20 may be swiveled in the left and right direction in conjunction with the steering of a steering handle.

Further, in the first and second embodiments described above, the heat sinks 30, 30A are disposed such that the horizontal base plate 31*a* is inclined rearward, and thus, the circulating air convection T vertically turning forward-upward and rearward-downward in the route of the lower air passage S1→the front air passage S2→above the reflector 24→the rear air passage S3→the lower air passage S1 is formed around the heat sinks 30, 30A. In this way, the heat-dissipation effect of the heat sinks 30, 30A is improved. However, the heat sinks 30, 30A may be disposed such that the horizontal base plate 31*a* is inclined forward, and thus, circulating air convection vertically turning rearward-upward and forward-downward may be formed around the heat sinks 30, 30A. In this way, the heat-dissipation effect of the heat sinks 30, 30A can be enhanced, and the light emitting element 22 and the lighting circuit unit 60 can be effectively cooled.

That is, by arranging the horizontal base plate 31*a* to be inclined forward, firstly, the movement of heat to the rear side of the heat sink 30 (horizontal base plate 31*a*) is promoted. Secondly, when the warmed air in the lower air passage S1 ascends along the lower surface of the horizontal base plate 31*a* inclined forward, the rearward flow of air is generated in the lower air passage S1. In this way, circulating air convection in which the direction of turning is opposite to that of the circulating air convection T formed in the first and second embodiments is formed around the heat sink 30. That is, the circulating air convection vertically turns rearward-upward and forward-downward in the route of the lower air passage S1→the rear air passage S3→above the reflector 22→the front air passage S2→the lower air passage S1.

Further, in the headlamps 10, 10A according to the first and second embodiments described above, the base plate 31 of the heat sinks 30, 30A is formed in the L-shaped longitudinal section including the horizontal base plate 31*a* and the vertical base plate 31*b*. However, the base plate 31 of the heat sinks 30, 30A may be constituted by only the horizontal base plate 31*a* without including the vertical base plate 31*b*.

That is, the heat-dissipation fins 34 extending on the lower side of the horizontal base plate 31*a* are formed in a substantially L shape in a side view extending in the front and rear direction beyond the horizontal base plate 31*a*. Specifically, the lower heat-dissipation fins 34*a* are continuous with the front heat-dissipation fins 34*b* extending substantially in the vertical direction to the front lower side of the horizontal base plate 31*a* and are also continuous the rear heat-dissipation fins 34*c*, 34*d* extending substantially in the vertical direction to the rear side of the horizontal base plate 31*a* in the up and down direction. In this way, the heat-dissipation fins 34 are formed in a plate shape in which the front heat-dissipation fins 34*b*, the lower heat-dissipation fins 34*a* and the rear heat-dissipation fins 34*c* (34*d*) are integrally continuous.

Further, in the above embodiments, the headlamps 10, 10A in which the light source unit 20 is disposed in the lamp chamber and the light source unit 20 for the headlamps are illustrated. However, the light source unit 20 may be used for a lighting device and lighting equipment such as a flashlight, a ceiling lighting, a spotlight, a search light and a projector. At that time, it is also possible to irradiate light by the projection lens 50 without providing the reflector 24. Further, instead of the reflector 24, a light guiding lens or an optical fiber may be adopted.

The invention claimed is:

1. A vehicle headlamp comprising:

a lamp body and a front cover disposed at a front opening portion of the lamp body so as to define a lamp chamber;

a heat sink including a metallic base plate and a plurality of heat dissipation fins;

a light source unit including a light emitting element and a reflector that reflects light emitted from the light emitting element toward a front of the lamp chamber, the light emitting element and the reflector being integrally mounted on an upper surface of the metallic base plate, the light source unit arranged in the lamp chamber, wherein the plurality of heat-dissipation fins are arranged in parallel in a left and right direction of the metallic base plate and are formed so as to extend in a front and rear direction from a front side of the metallic base plate to a rear upper side of the metallic base plate; and wherein at least a portion of the plurality of heat dissipation fins extend beyond a front edge of the front side of the metallic base plate.

2. The vehicle headlamp according to claim 1, wherein the metallic base plate is disposed to be inclined forward or rearward.

3. The vehicle headlamp according to claim 2, wherein the metallic base plate is disposed to be inclined rearward, front edge portions of the at least a portion of the plurality of heat-dissipation fins extending beyond the front edge of the front site of the metallic base plate are brought into contact with another constituent member of the light source unit disposed adjacent to a front of the heat sink or are integrated with an upright wall extending in the left and right direction, and a chimney is provided in an air passage constituted by the at least a portion of the heat-dissipation fins extending beyond the front edge of the front side of the metallic base plate.

4. The vehicle headlamp according to claim 1, wherein the metallic base plate is formed of an L-shape, a vertical portion of the L-shaped metallic base plate is formed in an arc shape in a plan view so as to at least partially surround the light emitting element, at least another portion of the plurality of heat-dissipation fins extend rearward from the metallic base plate in a radial direction with respect to the light emitting element, and extended ends of the at least another portion of the plurality of heat-dissipation fins are arranged in an arc shape in a plan view to follow the arc shape of the vertical portion of the L-shaped metallic base plate.

5. The vehicle headlamp according to claim 2 wherein the metallic base plate is formed of an L-shape, a vertical rod shaped portion of the L-shaped metallic base plate is formed in an arc shape in a plan view so as to at least partially surround the light emitting element, at least another portion of the plurality of heat-dissipation fins extend rearward from the metallic base plate in a radial direction with respect to the light emitting element, and extended ends of the at least another portion of the plurality of heat-dissipation fins are arranged in an arc shape in a plan view to follow the arc shape of the vertical portion of the L-shaped metallic base plate.

6. The vehicle headlamp according to claim 3 wherein the metallic base plate is formed of and L-shape, a vertical portion of the L-shaped metallic base plate is formed in an arc shape in a plan view so as to at least partially surround the light emitting element, at least another portion of the plurality of heat-dissipation fins extend rearward from the metallic base plate in a radial direction with respect to the light emitting element, and extended ends of the at least another portion of the plurality of heat-dissipation fins are arranged in an arc shape in a plan view to follow the arc shape of the vertical portion of the L-shaped metallic base plate.

7. The vehicle headlamp according to claim 3, wherein the plurality of heat dissipation fins extend from the front side of the base plate the same distance as from a rear side of the base plate.

8. A light source unit comprising:

a heat sink including a metallic base plate and a plurality of heat dissipation fins; and a light emitting element mounted on an upper surface of the metallic base plate wherein the plurality of heat-dissipation fins are arranged in parallel, extend from a lower surface of the metallic base plate, and also extend beyond the metallic base plate in a direction orthogonal thereof, and wherein at least a portion of the plurality of heat dissipation fins extend beyond a front edge of a front side of the metallic base plate.

9. A vehicle headlamp comprising:

a lamp body and a front cover disposed at a front opening portion of the lamp body so as to define a lamp chamber;

a heat sink including a metallic base plate and a plurality of heat dissipation fins;

a light source unit including a light emitting element and a reflector that reflects light emitted from the light emitting element toward a front of the lamp chamber, the light emitting element and the reflector being integrally mounted on an upper surface of the metallic base plate, the light source unit arranged in the lamp chamber, wherein the plurality of heat-dissipation fins are arranged in parallel in a left and right direction of the metallic base plate and are formed so as to extend in a front and rear direction from a front side of the metallic base plate to a rear upper side of the metallic base plate;

the metallic base plate includes an L-shaped section, and a vertical portion of the L-shaped section of the metallic base plate is formed in an arc shape in a plan view so as to at least partially surround the light emitting element.

* * * * *